US006659375B1

(12) United States Patent
Mudge et al.

(10) Patent No.: US 6,659,375 B1
(45) Date of Patent: Dec. 9, 2003

(54) ATOMIZER LID ASSEMBLY FOR AN ATOMIZER HEAD

(75) Inventors: Robert Mudge, Rapid City, SD (US); Shawn Veurink, Rapid City, SD (US)

(73) Assignee: RPM Solutions, Inc., Rapid City, SD (US)

( * ) Notice: Subject to any disclaimer, the term of this patent is extended or adjusted under 35 U.S.C. 154(b) by 0 days.

(21) Appl. No.: 10/085,852

(22) Filed: Feb. 26, 2002

(51) Int. Cl.[7] ..... B05B 1/00; B05B 3/10

(52) U.S. Cl. ..... 239/591; 239/214; 239/223; 239/224

(58) Field of Search ..... 239/214, 222, 239/223, 224, 591

(56) References Cited

U.S. PATENT DOCUMENTS 3,640,467 A * 2/1972 Moller et al. ..... 239/224
4,121,770 A * 10/1978 Straarup et al. ..... 239/224
4,303,200 A * 12/1981 Hansen ..... 239/223
RE32,064 E * 1/1986 Nielsen ..... 239/224
4,684,065 A * 8/1987 Svarrer ..... 239/224
4,898,331 A * 2/1990 Hansen et al. ..... 239/223
5,356,075 A * 10/1994 Heide et al. ..... 239/222.11

* cited by examiner

*Primary Examiner*—Robin O. Evans
(74) *Attorney, Agent, or Firm*—Caesar, Rivise, Bernstein, Cohen & Pokotilow, Ltd.

(57) ABSTRACT

A lid assembly for a rotatable atomizer wheel with an atomizing chamber therein for the receipt of a slurry through the lid assembly. The lid assembly includes a lid member with a first opening there through adapted to fit onto the rotatable atomizer wheel over the atomizing chamber. The lid assembly further includes a wear ring fitted inside and extending through the first opening through the lid member for protecting the exposed surface of the first opening through the lid member from wear caused by slurry flowing through the lid into the atomizing chamber.

7 Claims, 1 Drawing Sheet

ATOMIZER LID ASSEMBLY FOR AN ATOMIZER HEAD

FIELD OF THE INVENTION

The present invention generally relates to a rotating spray dryer atomizer wheel to be positioned in a treatment chamber for use in connection with flue gas desulfurization, and in particular relates to an improved lid and upper wear ring system for such an atomizer wheel.

BACKGROUND OF INVENTION

Flue gas desulfurization systems are typically used in coal fired power plants, waste-to-energy plants and in incinerators. A typical desulfurization system will include a processing or treatment chamber wherein flue gasses are subjected to desulfurization treatment. Positioned inside that chamber is a high speed rotating atomizing wheel or head through which a desulfurization treatment slurry is dispersed into the chamber and the gas therein in order to initiate the desulfurization process. Such a desulfurization system might typically be powered by drive systems that include motors in the 160 to 1100 horsepower range that rotate the atomizing heads at speeds of 8,800–10,000 rpm and upwards to 15,000 rpm. While these heads are rapidly rotating at these very high speeds, a slurry treatment mixture, typically of water, lime and fly ash of upwards to 20%–40% solids, is fed into the heads at rates ranging typically between 20–150 gallons per minute. Due to the rotational velocity of the heads, the slurry fed into the heads is accelerated and expelled through nozzles positioned around the circumference of the rotating heads into the treatment chamber. The atomized mist of the treatment slurry chemically reacts with the sulfur in the flue gasses to form solid particles that precipitate from the flue gas. These solid partiuclates formed from the chemical reaction of the atomized treatment slurry and the flue gasses are filtered out, thereby removing the sulfur from the flue gas.

An apparatus typical of the type of atomizing head or wheel that is the subject of the improvement of the present is shown in U.S. Pat. No. 5,370,310. Atomizer wheels of a similar type are also disclosed in U.S. Re. Pat. No. 30,966, U.S. Re. Pat. No. 30,963 and U.S. Pat. No. 5,356,075. In each of the atomizers disclosed in these patents, the atomizer wheels are circular with a circumferential sidewall that forms a hollow center or annular space. Nozzle openings project through the circumferential sidewall. A lid or cover plate fits over the annular space. In the lid is an opening or inlet through which slurry to be atomized passes into the annular space. The atomizer wheel is positioned within a treatment chamber wherein atomized slurry from the wheel reacts with the gasses in the chamber to desulfurize the gasses. Similar atomizer heads are also used in spray dryers for drying certain clays and mild solids.

In these prior atomizer wheels, the lids to the wheels are essential components of the wheel assemblies and are supplied as original equipment with the wheels. The lids are usually comprised of stainless steel or other materials such as titanium and hastelloys. A serious problem arises as a result of the flow of slurry materials into the wheel through the opening in the lid. The lid surface at the opening wears due to the slurry materials being forced there against, and the lid surface usually does not wear equally or concentrically around the opening. This wearing of the opening in the lid, and in particular the uneven wear, causes the lid to deteriorate, and the uneven nature of the wearing causes the wheel to have a balance problem at the high rotation speeds that the wheel operates under. Under these circumstances, even though the atomizer head itself and the nozzle components may wear well, it becomes frequently necessary to replace the stainless steel or other alloy material lid in order to compensate for this particular wear. Replacement of these lids is expensive: the lids themselves are expensive, and the down time of the treatment apparatus associated with removing the atomizer and replacing the lid is a further expense that must be considered. Operation of these scrubbing systems is critical to air quality, and any down time that can be eliminated or at least reduced results in overall savings.

In order to overcome the shortcomings associated with these prior types of lids associated with the atomizer heads, there have been attempts made to try to decrease wear at the inlet opening and thus increase the lid life. One prior attempt to compensate for wear at the lid inlet has been to coat the inlet opening with a layer of hardened material. In one particular attempt, multiple spray coatings of a wear-resistant material, for example tungsten carbide or chrome carbide material, were applied to the inlet opening to a thickness of approximately 0.050" to 0.060". Even though these spray coatings increased the wear life of the lid at the inlet opening significantly, the life expectancy of the lid was still considered inadequate.

Another problem closely associated with the atomizer lid construction of the types generally associated with these slurry atomizers involves slurry penetration into the o-ring groove area underneath the rim of the lid. As will be discussed in greater detail hereinafter, as the lid begins to wear, the injected slurry, due to the high centrifugal forces created within the rapidly rotating head, begins to flow or be urged past the rim of the lid into the area between the wear rings and the lid. The build up of slurry in this area can eventually cause the very brittle wear rings to crack since they do not tolerate bending very well. When this happens, not only does the worn lid need to be replaced, the associated wear ring must be replaced as well, adding further to the cost of maintenance and repair of the atomizer.

Because of these inherent deficiencies in the lid construction, lids that should have a lifespan of a number of years in reality have lifespans of a matter of months. The same is true of the life of the associated wear ring.

It is, therefore, desirable to provide an improved lid for the atomizer wheel or head that has superior wear qualities at its inlet opening through the lid. Furthermore, such an improved lid should be easy to substitute for the original equipment lid and at the same time provide a confirguration that will protect its associated wear ring so that the wear ring is secure from premature failure through breaking due to slurry penetrating between the wear ring and the lid.

SUMMARY OF THE INVENTION

A lid assembly is disclosed for a rotatable atomizer wheel with an atomizing chamber for the receipt of a slurry through the lid assembly. The lid assembly includes a lid member adapted to fit onto the rotatable atomizer wheel over the atomizing chamber. The lid member has an first opening there through directed into the atomizing chamber when the lid member is positioned on the atomizer wheel. In addition, the lid assembly includes a wear ring for protecting the exposed surface of the first opening through said lid member from slurry flowing through the lid. This wear ring is fitted inside and extends through the first opening through the lid member and has a second opening there through into the atomizing chamber, so that when the lid member with the wear ring fitted therein is positioned on the atomizer wheel there is an opening through to the atomizing chamber. The material of the wear ring has a greater wear resistance than the material of the lid member.

DETAILED DESCRIPTION OF THE PREFERRED EMBODIMENTS

Figure 1:
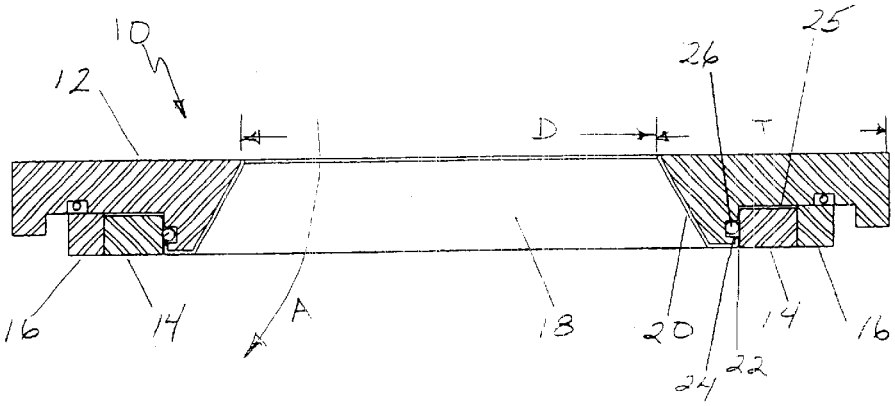
FIG 1 PRIOR ART
FIG. 1 is a cross-sectional view of a prior art atomizer lid and wear ring for an atomizer wheel.

Referring now in detail to the various figures of the drawings wherein like reference characters refer to like parts, there is shown in FIG. 1, an atomizer lid assembly 10 of the type presently available for use in conjunction with a rotating spray dryer atomizer wheel or head. Atomizer wheels and their lid assemblies are circular in shape, are will known in the art and will not be discussed generally at length here. Of particular concern to the present invention is the construction and configuration of the lid assembly 10 that fits onto the atomizer wheel. The prior art lid assembly 10 as shown in cross-section in FIG. 1 includes a lid member 12, an associated wear ring 14 directly adjacent the lid member 12 and a containment ring 16 for the wear ring 14 that acts as a physical restraint for the wear ring when the atomizer wheel is rotating at high speeds. A lid member 12 of the type shown in FIG. 1 is an essential structural component for rotating atomizer head assemblies. The lid member 12 has an inlet opening 18 therethrough that is concentric with the axis of rotation of the lid assembly. As further shown in FIG. 1 at the arrows A, desulfurization slurry, typically a mixture of water, lime and fly ash, flows downward through the lid member 12 and the inlet opening 18 into the body of the atomizer wheel through the lid.

Lids that are supplied as original equipment from the manufacturer are usually comprised of stainless steel, Hastelloy or titanium. The wear rings 14 are typically made of silicon carbide, which is very hard and wear-resistant, but also is very brittle. Usually, on original equipment lid members, the inlet opening 18 is not coated or protected from wear in any fashion, and it is for this reason that the lid member 12 begins to wear quickly at the inlet opening 18 due to repeated and continuous contact with the abrasive slurry flow. In some instances, the inlet opening may have been coated with a thermal spray coating layer as shown at 20 in FIG. 1. The layer 20 is typically a spray coating of wear-resistant material, e.g., chrome carbide, having a thickness of 0.050" to 0.060". However, even with this spray coating of chrome carbide, the lid member 12 at the inlet opening 18 begins to abrade and wear quickly.

Obviously, the wearing away of the circumference around the inlet opening 18 is not desirable. Moreover, the fact that the wear is not usually equal or concentric around the opening results in an imbalance in the weight of the atomizer wheel. This imbalance is further exaggerated because of the very high rotational speeds of the atomizer wheel. Furthermore, even as the surface of the inlet opening 18 continues to wear away, the slurry also has a wearing affect the edge of the lid 12 adjacent the wear ring 14. As the lid begins to wear, particularly at the interface 22 between the lid member 12 and the wear ring 14, the slurry, which is under extreme force inside the rotating atomizer wheel begins to work its way into the interface 22 and into a first o-ring recess 24 occupied by an o-ring 26. Original equipment wear rings are usually made of extremely hard, but brittle, silicon carbide. As a consequence, the wear rings do not tolerate bending forces or uneven movement very well. When the slurry begins to urge between the lid member 12 and the wear ring 14, as at the interface 22, and fill the o-ring space 24, including the top surface interface 25 at the top of the wear ring 14 adjacent the lid member 12, excessive and uneven centrifugal forces begin to urge against the wear ring 14 and cause the wear ring to crack or break. Therefore, the uneven and premature wearing away of the surface of the inlet opening through the lid member 12 not only destroys the longevity of the lid member 12, but also diminishes the life of the wear ring 14.

Figure 2:
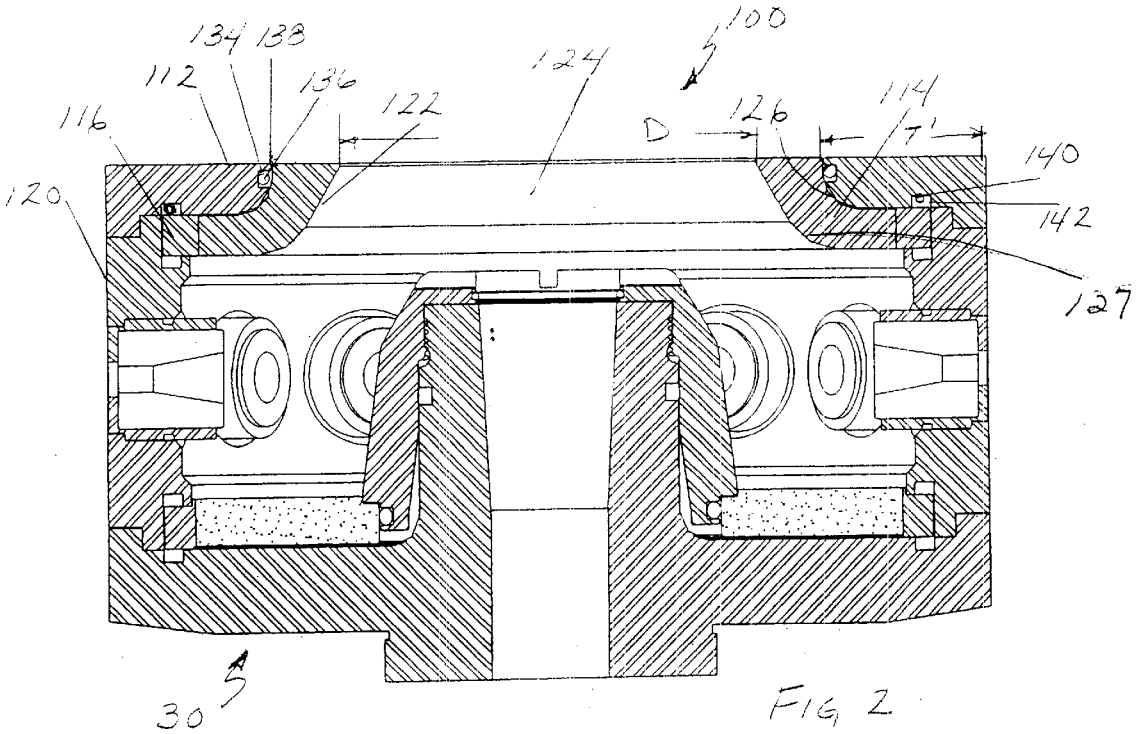
FIG. 2 is a cross-sectional view of the improved lid and wear ring of the present invention in place in a typical atomizer wheel.

In order to overcome these problems created by the uneven and premature wear of the surface of the inlet opening 18 through the atomizer lid member into the atomizer wheel, a new atomizer lid assembly 100 as shown in FIG. 2 has been developed. FIG. 2 shows a typical assembled atomizer head assembly 30 in cross-section. Like the previous lid assembly 10 shown in FIG. 1, the improved lid assembly 100 shown in FIG. 2 includes a lid member 112, a wear ring 114, and a containment ring 116 between the wear ring 114 and the sidewall 120 of the atomizer head assembly 30.

Unlike the lid assembly 10 shown in FIG. 1, however, in the atomizer lid assembly 100 shown in FIG. 2, the surface 122 exposed at what is the inlet opening 124 into the atomizer head is not the surface of the lid member 112, like the surface 20 in FIG. 1, nor is it a sprayed coating on the lid member. Rather, the exposed surface 122 is comprised of the wear ring 114 surrounding the surface of the central opening 126 of the lid member 112 and extending to abut the containment ring 116. Reshaping and extending the wear ring 114 to surround the atomizer lid member 112 results in important benefits that increase the life of the lid assembly as a whole, and in particular the lives of the wear ring 114 and the lid member 112, individually.

First of all, in understanding the new atomizer lid assembly 100, it is important to realize that the outside diameter of the atomizer lid assembly 100 remains constant, i.e. is the same size as the prior lid assembly it replaces. This new equipment is sized to fit as an exact sized replacement for use in an existing a head assembly, so the outside diameter cannot be varied. Moreover, the diameter D of the inlet openings 18, 124 into the atomizer head assemblies 10, 100 as shown in both FIGS. 1 and 2, remains constant so that the flow of slurry into the atomizer head is not varied as a result of incorporating the improved atomizer lid assembly into a standard atomizer head assembly 30. In order to maintain this constant diameter D and the inlet opening 124 into the atomizer head assembly, although the outside diameter of the atomizer lid member 112 remains constant, the diameter of the central opening 126 through the lid member has been increased by reshaping the lid member 112 to have a narrower thickness $T^1$. On the other hand, the wear ring 14 that was previously positioned between the atomizer lid 12 and the containment ring 16 in the structure shown in FIG. 1, has been reshaped and repositioned in the embodiment of the invention shown in FIG. 2.

The newly configured wear ring 114 has been increased in size as shown in FIG. 2 to surround the surface of the central opening 126 of the atomizer lid member 112. The new shape and thickness of the wear ring 114 compensate for the amount of the atomizer lid member 112 material removed to that the opening diameter remains essentially constant in comparison to the size of the original lid member shown in FIG. 1. In addition, the shape of the opening 124 through the wear ring is preferably shaped to have an angle substantially the same as the angle of the opening through the lid member in the prior embodiment. This way the flow pattern of the slurry into the head assembly should not vary greatly with the new lid assembly. The bottom edge 127 of the wear ring has been slightly modified with a radius edge in an effort to improve slurry feed into the head. The curved radius is intended to smooth the flow at the bottom edge of the wear ring and thereby reduce stress on the parts comprising the new lid assembly. In this new embodiment, the wear ring 114 completely covers the surface of the central opening 126 and is the only wear component of the lid assembly 100. Preferably the cross-sectional thickness of the wear ring 114 will range from approximately 0.584" to 0.985". However, it is recognized that such dimensions will vary with the particular environment and importantly size of the atomizer head.

It is recommended that the wear ring 114 be replaced when the thickness of the ring reaches half of its original thickness. However, by providing this newly shaped wear ring 114 that is replaceable, it is no longer necessary to constantly replace the atomizer lid member 112 because of wearing of the surface of the central opening of the lid member.

A still further change in the formation of the atomizer lid member 112 is the relocation of the first o-ring recess 134 to reposition the o-ring 136 seal between the wear ring 114 and the atomizer lid member 112. No longer is the first o-ring recess 134 positioned as shown at 24 in FIG. 1, at the rearward edge of the overhang of the atomizer lid member 12 adjacent the wear ring 14 With construction of the lid member 112 as provided in the invention, the o-ring seal joint or interface 138 can not disrupt the flow of the slurry material into the atomizer head. Aside from the danger of increased susceptibility of wear to the wear ring 14 due to slurry flow into the recess and into the interface 22 above the wear ring 14 as was discussed with the prior embodiment shown in FIG. 1, the very presence of the joint between the lid member 12 and the wear ring 14 creates a surface that interrupts the smooth surface of the opening in lid and causes a flow turbulence that increases the possibility of localized wear on the undersurface of the lid that may cause a further imbalance problem.

The location of the second o-ring member 140 and its corresponding recess 142 in the new atomizer lid member 112 has not been changed.

The new configurations of the atomizer lid member 112 and the wear ring member 114 result in a new and improved atomizer lid assembly that is not subjected to the wear at the inlet opening of the lid member as was found in the prior embodiment shown in FIG. 1, nor is there the likelihood of slurry particles getting into the o-ring space or the interface between the wear ring 114 and the atomizer lid member 112 that often previously resulted in the failure of the brittle wear ring. By simply reshaping the dimensions of the atomizer lid member 112 and surrounding the surface of its central opening 126 with the reconfigured wear ring 114, the atomizer lid member 112 is no longer subjected to continuous wear and degradation as a result of the abrasive slurry flowing through the opening in the atomizer head assembly. Moreover, because the wear ring 114 has always been and still is comprised of wear resistant material such as silicon-carbide material, tool steel, and heat treated stainless steel or carbide castings that is much more resistant to abrasion caused by the slurry than the atomizer lid, the wear ring 114 is far less susceptible to wear than the atomizer lid member that is made of metal or alloy. In addition, by changing the location of the first o-ring recess 134 to a position higher up in the central opening 126 of the atomizer lid member 112, it is far less likely that any of the slurry flowing into the atomizer head assembly 30 will be able to find its way into the recess or the interface between the lid member 112 and the wear ring 114 and ultimately urge against the wear ring 114 and cause it to crack or break. Still further, the positioning of the wear ring 114 totally around the surface of the central opening 126 of the lid member 112 so that the wear ring only abuts the containment ring 116 eliminates a joint structure that can cause unnecessary turbulence within the atomizer head.

Finally, an even further benefit of providing the newly positioned and shaped wear ring 114 is the ability to reuse, rather than discard, a worn atomizer lid member 12 such as that shown in FIG. 1. By just reshaping the worn lid member and relocating the first o-ring recess 134, the previously used lid member can be reused by positioning the newly formed wear ring 114 in place against it. This ability to reuse, rather than discard the worn lid member, and the ability to continue to reuse the lid member since no further abrasion of it will take place is a definite savings over having to replace the entire lid member every time the central opening becomes worn.

Without further elaboration, the foregoing will so fully illustrate our invention that others may, by applying current or future knowledge, readily adopt the same for use under various conditions of service.

We claim:

1. A lid assembly for a rotatable atomizer wheel having an atomizing chamber therein, said lid assembly comprising:

a lid member adapted to fit onto the rotatable atomizer wheel over the atomizing chamber, said lid member having an first opening there through into the atomizing chamber when said lid member is positioned on the atomizer wheel; and a wear ring for protecting the first opening through said lid member, said wear ring being fitted inside and extending through the first opening through said lid member, said wear ring having a second opening there through into the atomizing chamber when said lid member with said wear ring fitted therein is positioned on the atomizer wheel.

2. A lid assembly as claimed in claim 1, further comprising a containment ring adjacent said lid member and surrounding said wear ring.

3. A lid assembly as claimed in claim 1, wherein said wear ring is comprised of a wear resistant material having greater wear resistance that the lid member.

4. A lid assembly as claimed in claim 1, wherein said wear ring is comprised of a material selected the group of materials consisting of silicon carbide material, tool steel, heat treated stainless steel and carbide castings.

5. A lid assembly as claimed in claim 1, wherein said lid member is comprised of a material selected form the group of materials consisting of stainless steel, Hastelloy and titanium.

6. A lid assembly as claimed in claim 1, wherein said first opening through said lid member has a first recess around the circumferences thereof; and wherein said lid assembly further comprises first cushioning and sealing means within the first recess in said lid member and adjacent said wear ring.

7. A lid assembly as claimed in claim 6, further comprising a containment ring adjacent said lid member and surrounding said wear ring, and wherein said lid member has a second recess therein adjacent said containment ring, and wherein said lid assembly further comprises second cushioning and sealing means within the second recess in said lid member and adjacent said wear ring.

* * * * *

US006659375C1

(12) EX PARTE REEXAMINATION CERTIFICATE (8512th)

United States Patent
Mudge et al.

(10) Number: US 6,659,375 C1
(45) Certificate Issued: Sep. 6, 2011

(54) ATOMIZER LID ASSEMBLY FOR AN ATOMIZER HEAD

(75) Inventors: Robert Mudge, Rapid City, SD (US); Shawn Veurink, Rapid City, SD (US)

(73) Assignee: RPM Solutions, Inc., Rapid City, SD (US)

Reexamination Request:
No. 90/007,333, Dec. 7, 2004

Reexamination Certificate for:

| | |
|---|---|
| Patent No.: | **6,659,375** |
| Issued: | **Dec. 9, 2003** |
| Appl. No.: | **10/085,852** |
| Filed: | **Feb. 26, 2002** |

(51) Int. Cl.
*B05B 1/00* (2006.01)
*B05B 3/10* (2006.01)

(52) U.S. Cl. ..... 239/591; 239/214; 239/223; 239/224

(58) Field of Classification Search ..... None
See application file for complete search history.

(56) References Cited

U.S. PATENT DOCUMENTS

| | | | |
|---|---|---|---|
| 3,454,226 | A | 7/1969 | Nielsen |
| 3,640,467 | A | 2/1972 | Moller et al. |
| 3,887,133 | A | 6/1975 | Straarup et al. |
| 4,121,770 | A | 10/1978 | Straarup et al. |
| 4,303,200 | A | 12/1981 | Hansen |
| RE32,064 | E | 1/1986 | Nielsen |
| 4,684,065 | A | 8/1987 | Svarrer |
| 4,898,331 | A | 2/1990 | Hansen et al. |
| 5,356,075 | A | 10/1994 | Heide et al. |
| 5,370,310 | A | 12/1994 | Willan |

OTHER PUBLICATIONS

1999 Dry Scrubber User's Conference Publication, Sep. 28–Oct. 1, 1999, Steamboat Springs, CO.

2000 Dry Scrubber User's Conference Publication, Sep. 11–14, 2000, Fort Collins, CO.

*Primary Examiner*—Joseph A. Kaufman

(57) ABSTRACT

A lid assembly for a rotatable atomizer wheel with an atomizing chamber therein for the receipt of a slurry through the lid assembly. The lid assembly includes a lid member with a first opening there through adapted to fit onto the rotatable atomizer wheel over the atomizing chamber. The lid assembly further includes a wear ring fitted inside and extending through the first opening through the lid member for protecting the exposed surface of the first opening through the lid member from wear caused by slurry flowing through the lid into the atomizing chamber.

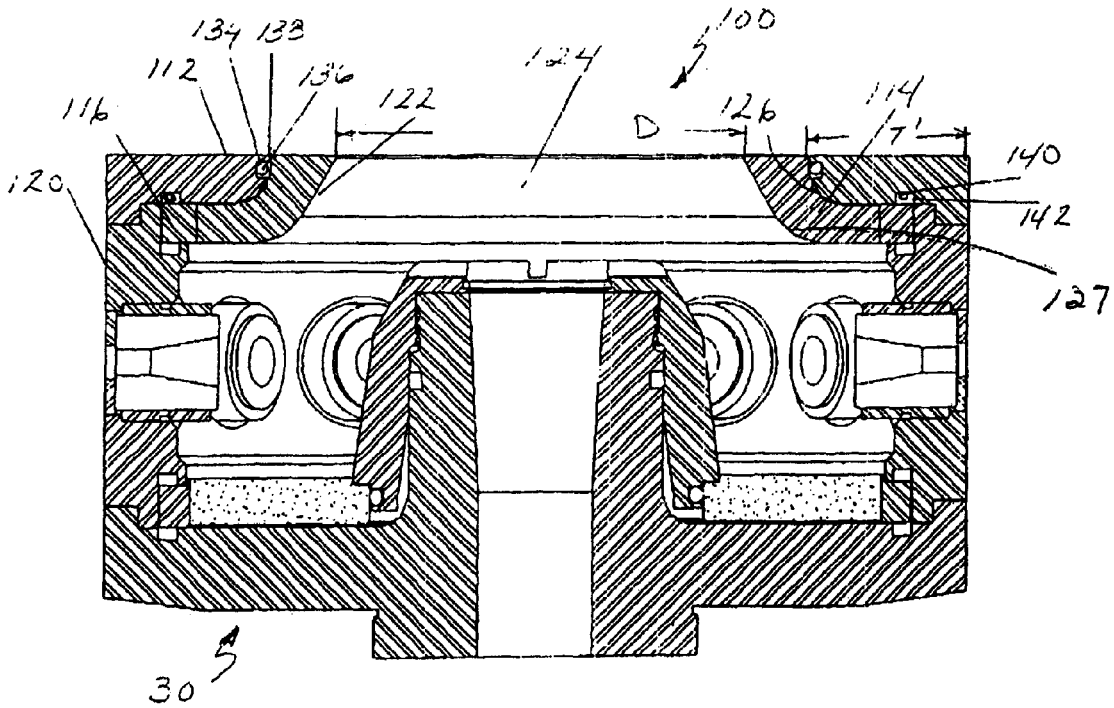

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1-5 are cancelled.

Claim 6 is determined to be patentable as amended.

Claim 7, dependent on an amended claim, is determined to be patentable.

6. A lid assembly [as claimed in claim 1,] *for a rotatable atomizer wheel having an atomizing chamber therein, said lid assembly comprising:*

*a lid member adapted to fit onto the rotatable atomizer wheel over the atomizing chamber, said lid member having an first opening there through into the atomizing chamber when said lid member is positioned on the atomizer wheel;*

*a wear ring for protecting the first opening through said lid member, said wear ring being fitted inside and extending through the first opening through said lid member, said wear ring having a second opening there through into the atomizing chamber when said lid member with said wear ring fitted therein is positioned on the atomizer wheel;* wherein said first opening through said lid member has a first recess around the [circumferences] *circumference* thereof; and wherein said lid assembly further comprises first cushioning and sealing means within the first recess in said lid member and adjacent said wear ring.

* * * * *